US009526974B2

(12) United States Patent
Bennert et al.

(10) Patent No.: US 9,526,974 B2
(45) Date of Patent: Dec. 27, 2016

(54) QUICK UNCOUPLING/COUPLING SKI POLE STRAP

(71) Applicant: One Way Sport Oy, Vantaa (FI)

(72) Inventors: Andreas Bennert, Vantaa (FI); Lauri Kettunen, Tampere (FI); Antti Nikkola, Tampere (FI)

(73) Assignee: ONE WAY SPORT OY, Vantaa (FI)

( * ) Notice: Subject to any disclaimer, the term of this patent is extended or adjusted under 35 U.S.C. 154(b) by 0 days.

(21) Appl. No.: 14/939,592

(22) Filed: Nov. 12, 2015

(65) Prior Publication Data

US 2016/0136507 A1 May 19, 2016

(30) Foreign Application Priority Data

Nov. 13, 2014 (FI) ..... 20145997

(51) Int. Cl.
*A63C 11/22* (2006.01)
*A45B 9/02* (2006.01)

(52) U.S. Cl.
CPC ..... *A63C 11/227* (2013.01); *A45B 9/02* (2013.01); *A63C 11/222* (2013.01); *A63C 11/228* (2013.01); *A45B 2009/025* (2013.01)

(58) Field of Classification Search
CPC ... A63C 11/221; A63C 11/222; A63C 11/227; A63C 11/228
See application file for complete search history.

(56) References Cited

U.S. PATENT DOCUMENTS 5,110,154 A * 5/1992 Street ..... A41D 19/0037 135/72
5,312,134 A * 5/1994 Goode ..... A41D 19/0037 2/160
5,328,205 A * 7/1994 Bacharach ..... A63C 11/222 135/72
5,443,287 A 8/1995 Wells
6,264,242 B1 * 7/2001 Lenhart ..... A45B 9/02 280/821
RE38,573 E 8/2004 Wells
2011/0296653 A1 12/2011 Fiedler

FOREIGN PATENT DOCUMENTS

EP 1 970 105 A1 9/2008
WO 96/34665 A1 11/1996

OTHER PUBLICATIONS

Finnish Search Report, dated Jun. 18, 2015, from corresponding Finnish Application.

* cited by examiner

*Primary Examiner* — John Walters
*Assistant Examiner* — James Triggs
(74) *Attorney, Agent, or Firm* — Young & Thompson

(57) ABSTRACT

A combination of a handle and a strap of a ski pole, the strap adapted to be between a hand of a person and the handle, and the combination allowing a quick uncoupling/re-coupling of the strap with the hand from/to the pole handle. The handle includes a handle body fixed on the pole, a locking base fixed in the body, a slide movable in respect to the body and locking base, an unlock lever communicating with the slide while shifted in respect to the body; and a pin having a first end with a widening and a second end fixing the pin to the strap in a predetermined area thereof. The strap is shaped to enclose by contact and extend around a palm and a wrist and between a thumb and forefinger by tightening. The predetermined area of the strap is centrally within the strap, between the thumb and forefinger.

8 Claims, 4 Drawing Sheets

QUICK UNCOUPLING/COUPLING SKI POLE STRAP

FIELD OF THE INVENTION

The novel construction relates to a ski pole, and specifically a handle in the upper end of a ski pole, and more specifically a handle assembly connected to an upper end of the ski pole, which ski pole is preferably intended for cross-country skiing. More particularly the handle assembly has a quick release strap, and the ski pole with this handle is very appropriate for biathlon skiing. Biathlon means skiing of defined legs and generally rifle shooting between the consecutive legs. Thanks to the quick release ski pole straps the skier can rapidly either couple his/her hand to the ski poles for starting the skiing of the next leg, or uncouple his/her hand from the ski poles for performing the shooting in the shooting spot. Further, the novel method relates both a quick uncoupling a strap on a hand from a handle of a ski pole, and a quick re-coupling a strap on a hand to a handle of a ski pole.

BACKGROUND OF THE INVENTION

Ski poles as such are generally known. Associated with a ski pole grip there are e.g. loop-type straps through which the skier inserts his hand so that the strap effectively wraps around the wrist as the skier grasps the hand grip and poles his way along the path of travel. In certain skiing competitions, it is imperative that the skier be able to rapidly release and reattach his hands to the ski poles. For instance, in Olympic biathlon competition, the skier traverses a cross country path and periodically must stop, take a rifle from the shoulder, fire at targets and then move on to a next station. In such competition, seconds are important.

A biathlon competition consists of a race in which contestants ski around a cross-country trail system, and where the total distance is broken up by some—typically two or four—shooting rounds, generally half in prone position, the other half standing. Depending on the shooting performance, extra distance or time is added to the contestant's total running distance or time. As in most races, the contestant with the shortest total time wins. A traditional strap permanently fixed to the handle in the upper end of the ski pole or a traditional strap interchangeably fixed to the handle in the upper end of the ski pole does neither allow a quick loosening of the skier's hand nor a quick reattaching of the skier's hand. Instead the skier must dribble his/her hands out of the holes of the straps and respectively dribble his/her hands back into the holes of the straps, which take considerable time. This time delay is critical e.g. in biathlon skiing, because the shooting in fact should be exercised by unloaded hands to attain good shooting results.

Document U.S. Pat. No. 5,110,154 discloses a ski glove having a strap extending diagonally across the palm and between a thumb-receiving pocket and an index finger-receiving pocket. The special strap is fastened to the rear of the glove and includes a clip thereon for engaging a mating latch mechanism formed on the hand-grip of a ski pole such that the skier may more rapidly engage and disengage his hand from the ski pole than can be accomplished when conventional ski pole straps are employed.

Document U.S. Pat. No. 5,443,287 discloses a quick release skip pole strap system including a novel ski pole strap that attaches to a ski pole grip. A locking mechanism within the ski pole grip automatically engages with a strap pin. A button attached to a side of the ski pole grip, when depressed, causes the strap pin to automatically eject from the ski pole grip decoupling the skier from the ski pole. The skier can depress the button without having to remove his hands from the ski pole grips. The ski pole strap is preferably made of an elastic material that automatically pulls the pin from the ski pole grip and holds the ski pole in a "ready to plant" position. There is an attachment mechanism disposed within the ski pole grip for receiving and locking the strap pin to the ski pole grip. The strap pin is insertable inside the ski pole grip and mechanically engaging with the attachment mechanism biasing the strap into a stretched condition. The strap in its stretched condition exerts constant force on the strap pin away from the ski pole grip. There is further a button extending from the ski pole grip and mechanically coupled to the attachment mechanism, whereupon the button is movable into a depressed condition mechanically disengaging the strap pin from the attachment mechanism. Then the strap in an unbiased condition returns to the given unstretched length forcing the strap pin out of the ski pole grip. This button is depressible by the hand of the skier and the strap changing from the biased to the unbiased condition while the same hand simultaneously remains wrapped around the ski pole grip.

Document US RE38,573 E, being a divisional of the above mentioned patent U.S. Pat. No. 5,443,287, also discloses a quick release skip pole strap system including a ski pole strap that attaches to a ski pole grip. A locking mechanism within the ski pole grip automatically engages with a strap pin. A button attached to a side of the ski pole grip, when depressed, causes the strap pin to automatically eject from the ski pole grip decoupling the skier from the ski pole. The skier can depress the button without having to remove his hands from the ski pole grips. Here, too, the ski pole strap is made of an elastic material that pulls the pin from the ski pole grip.

With the above mentioned conventional ski poles, valuable time may be lost when it becomes necessary to release the straps from the ski pole grips so that he may grasp his rifle and begin firing. Similarly, when the shooting phase at a particular station has been completed, the skier must again manipulate straps to the ski pole before taking off down the trail. It shall be noted that both the uncoupling of the hand from the handle and the re-coupling of the hand to the handle must be quick processes.

SUMMARY OF THE INVENTION

The object of the present invention is to provide a quick uncoupling/re-coupling solution for coupling a strap with a grip of a ski pole, in which solution disadvantages of prior art solutions are avoided or diminished.

In order to overcome the above mentioned problems it is described a special and novel combination of a handle and a strap of a ski pole. The strap is adapted to extend between the hand of a skier, and the combination allows a quick uncoupling/re-coupling of the strap with the hand from/to the ski pole handle. The handle comprises: A handle body securely fixed on the ski pole, a locking base fixed in the body, a slide movable in respect to the body, and an unlock lever communicating with the slide while shifted in respect to the body. There is a pin having a first end with a widening and a second end fixing said pin to the strap in a predetermined area thereof.

The strap is shaped to enclose by contact and extend around a palm and a wrist of the hand by tightening. The predetermined area of the strap is centrally within said strap, and between a thumb and a forefinger of the hand. The widening of the pin is of a soft ferromagnetic material. Further, the handle comprises: a slide spring between the slide and the base, a lever spring between the unlock lever and the handle body, and one or more permanent magnet(s) of hard ferromagnetic material(s) for co-action with the widening of soft ferromagnetic material. And still further, the handle comprises and a cavity respective the size of said widening in said locking base, and a transverse groove opening outside at a lower edge of the slide, so that a beam between said first and second ends of the pin extends out of the locking base to outside of the slide.

BRIEF DESCRIPTION OF THE DRAWINGS

In the following the invention is described with help of the enclosed drawings, in which.

DETAILED DESCRIPTION OF THE PREFERRED EMBODIMENTS

Figures 1A, 1B:
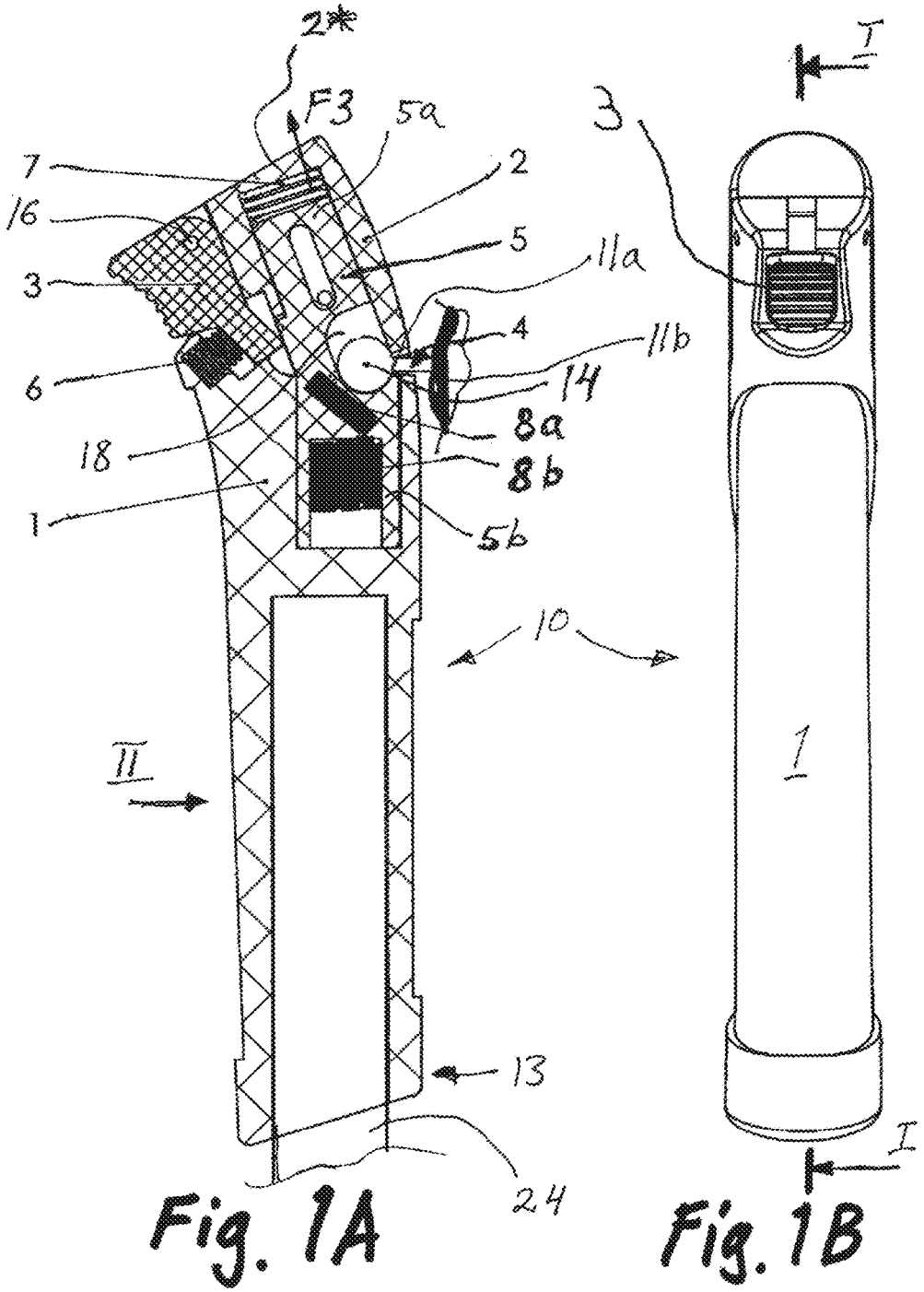
FIG. 1A represents a preferred construction of the ski pole handle with the quick uncouple/re-couple strap according to the invention, in the cross-sectional plane I-I of FIG. 1B.
FIG. 1B represents the ski pole handle with the quick release strap according to the invention, seen from outside of the handle in the direction II of FIG. 1A.

The skiing idea concerns a handle 10 of a ski pole 13. The ski pole 13 comprises a longitudinal shaft 24. The shaft is typically linear/straight, but may of course have some curvature or minor bends without an effect concerning the function the handle 10. These kinds of curves or bends, not shown in the figures, may be used for other reasons, like visual or aerodynamic purposes. The handle 10 is fixed on the upper end of the shaft 24 so that it can be grabbed by the skier by his hand 12. The lower end of the shaft—i.e. the opposite end to the mentioned upper end—has a tip, which can include a spike or stud with its attachment elements to form a contact with snow and/or ice on ground during skiing. It is emphasized that in this text the definitions "upper" and "lower" means the relative locations of the parts in question while the ski pole 13 is in the upright or vertical using positions of the cross country skiing, as generally known.

The ski pole also has a basket attached around the shaft between the shaft and the tip. The basket is a ring- or plate- or mesh- or grating-like element for the purpose to prevent any excessive sinking of the ski pole into the snow during skiing, as generally known in the context of cross country skiing. The handle 10 comprises a body 1 which is securely fixed on the shaft 24, more precisely on the upper end of the shaft. The above mentioned parts of the ski pole are generally known and used at least for hundreds—maybe thousands—of years in various designs, and are accordingly not explained more in detail here. A skier typically uses a pair of similar ski poles 13, one ski pole by one—right or left—hand and a another ski pole by another hand. Of course these two similar ski poles may have details configured like mirror images. During skiing these two ski poles may be used either symmetrically phased, or alternately phased. These phasing types are generally knowledge of every person who manages skiing, and is accordingly not explained more in detail.

The novel ski pole construction and system teaches and uses a combination of a handle 10 and a strap 9 of a ski pole 13, whereupon the strap is adapted to be between a hand 12 of a person—in this case a skier, more specifically a biathlete—and the handle 10. The novel combination allows a very quick and secure uncoupling of the strap 9 with the hand 12 from the ski pole handle 10, and a very quick and secure re-coupling of the strap 9 with the hand 12 to the ski pole handle 10, as well. For this purpose the handle 10 comprises a handle body 1 well or permanently fixed on the ski pole in its upper end as usual, a locking base 5 fixed in this body 1, a slide 2 movable in respect to the body 1, and an unlock lever 3 communicating with the slide 2 while shifted in respect to the body 1. There is also a pin 4 having a first end 11*a* with a widening 14 and a second end 11*b* fixing the pin to the strap 9, which fixing is in a predetermined area A of the handle.

Figure 3:
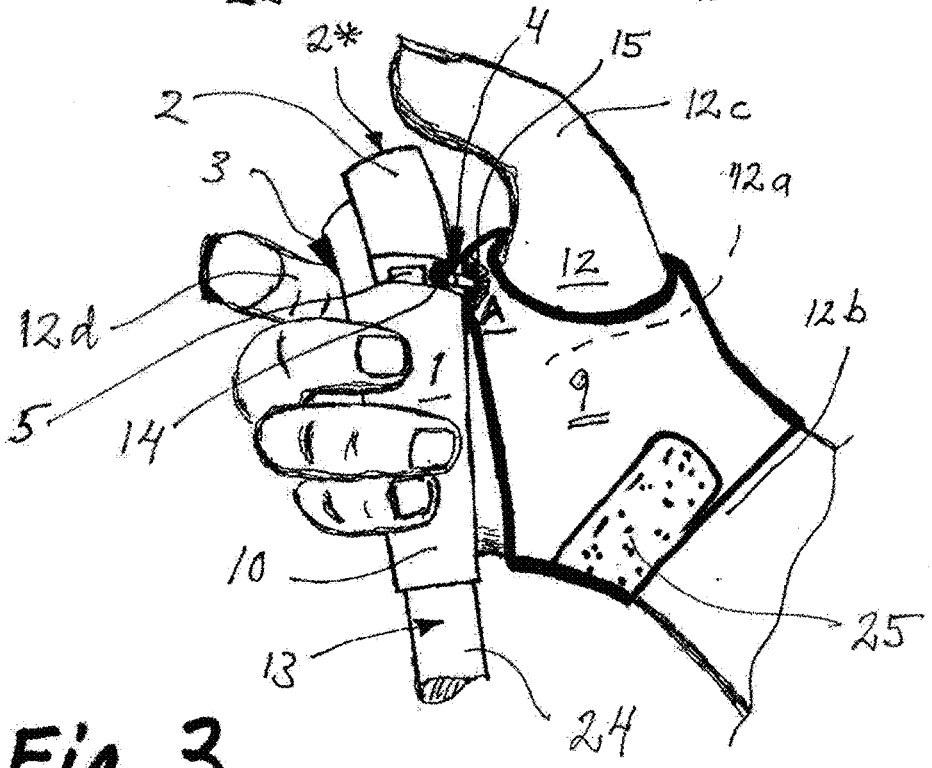
FIG. 3 visualizes a skier's hand touching the handle with the strap according to the invention in a position where the hand is either drawing the strap away from the handle for uncoupling, or—vice versa—pushing the strap towards the handle for re-coupling, seen towards the palm of the hand.
Figure 4:
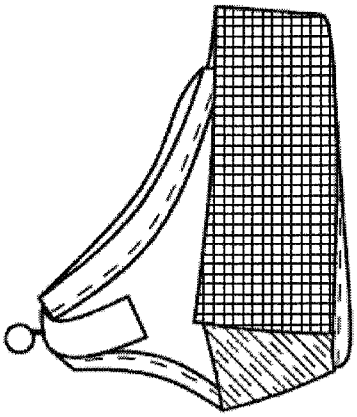
FIG. 4 illustrates an exemplary embodiment of a hand strap in accordance with the invention.
Figure 5A:
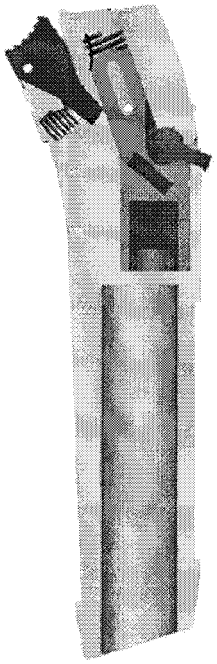
FIG. 5A and FIG. 5B illustrate an exemplary embodiment of a handle in accordance with the invention.
Figure 5B:
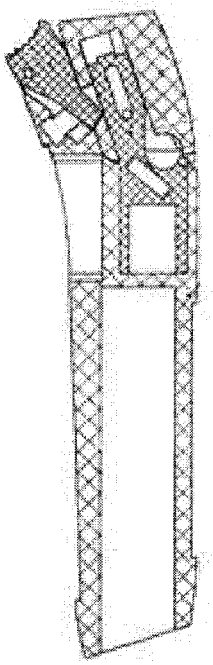

According to the invention the strap 9 is shaped to enclose by contact the hand 12 and to extend around a palm 12*a* and the back of hand—and between a thumb (12*c*) and the forefinger (12*d*)—and possibly/typically around a wrist 12*b* of the hand, too. The strap is secured to stay in this preferred position around the hand using tightening, which is attained by fastener(s) 25—that may be any kind of hook-and-loop fasteners, hook-and-pile fasteners, or touch fasteners, or any type of band or belt with a buckle or clasp, or the like. The strap 9 hence extends around the palm and the back of the hand, and further extends from the palm covering side to the back of the hand covering side, which extending area is between the thumb and the forefinger. The hand strap is; accordingly, like a bounded glove, but with armseyes instead of fingers encasing sections. Of course the strap 9 has binding elements 25, with which the strap 9 is tightened around the hand 12. The mentioned predetermined area A of the strap is centrally within the strap 9, and more specifically between the thumb 12*c* and the forefinger 12*d* of the hand, that respects the above mentioned extending area, and absolutely not in any band or the like separate from the described hand strap. In fact the strap 9 according the invention may not have any ends at all, but approaches a tubular form with a crossing portion between thumb and forefinger, as can be understood with the aid of FIG. 3.

The above mentioned widening 14 in the first end of the pin 4 is typically spherical, or almost spherical, or ellipsoid or almost ellipsoid, so that the widening has a proper roundness allowing its easy insertion into the cavity 18, described later, and allowing its easy pulling out of the cavity 18. The pin 4 has also a transverse flange 15 or a hole in the second end thereof enabling fixing of the pin to the non-stretch material of the strap 9. There is a linear beam 19 between the widening 14 and the transverse flange 15. The flange 15 may have one or several hole(s) to improve and/or to facilitate the fixing between the flange and the strap. Specifically, the widening 14 of the pin 1 is made of a soft ferromagnetic material. The pin 4 is drawn out of and inserted into the handle 10 by hand forces of the skier/biathlete.

Further according to the invention, the handle 10 comprises a slide spring 7 between the slide 2 and the base 5, a lever spring 6 between the unlock lever 3 and the handle body 1, and one or more permanent magnets 8*a*, 8*b* made of one or several hard ferromagnetic materials. These permanent magnets 8*a*, 8*b* co-act with the widening 14 made of the soft ferromagnetic material, so that at least the insertion of the pin 4 and its re-coupling is ensured and happens without delays. The mentioned cavity 18 respects the size of the widening 14 in the locking base, so that the widening 14 has adequate room in the cavity 18. There is a transverse groove 20 opening outside at a lower edge 21 of the slide 2 across the wall thickness of the slide, so that the beam 19 between the first and second ends of the pin 4—i.e. between the widening 14 and the flange 15—extends out of the locking base to outside of the slide. The described structure allows that the widening 14 sits in the cavity 18 and the beam 19 extends through the groove 20 outside the handle until the strap 9 with the flange 15 there within—this situation is when the strap and the hand are coupled to the handle for skiing.

The locking base 5 has an upper section 5*a* and a lower section 5*b*, and the slide spring 7 is between the mentioned upper section 5*a* and the top 2* of the slide 2, so as to force the slide in its opening direction D—i.e. the slide spring 7 is in its compressed state between the base 5 and the top of the slide 2. The slide 2 has a configuration enabling a sliding of the slide 2 along the locking base 5 both in opening direction D and in opposite closing direction C. The unlock lever 3 has a revolve axis 16 transverse to the length L of the handle 10, and the lever spring 6 is pressing the unlock lever against the slide, thus hindering sliding movement of the slide.

Figure 2A:
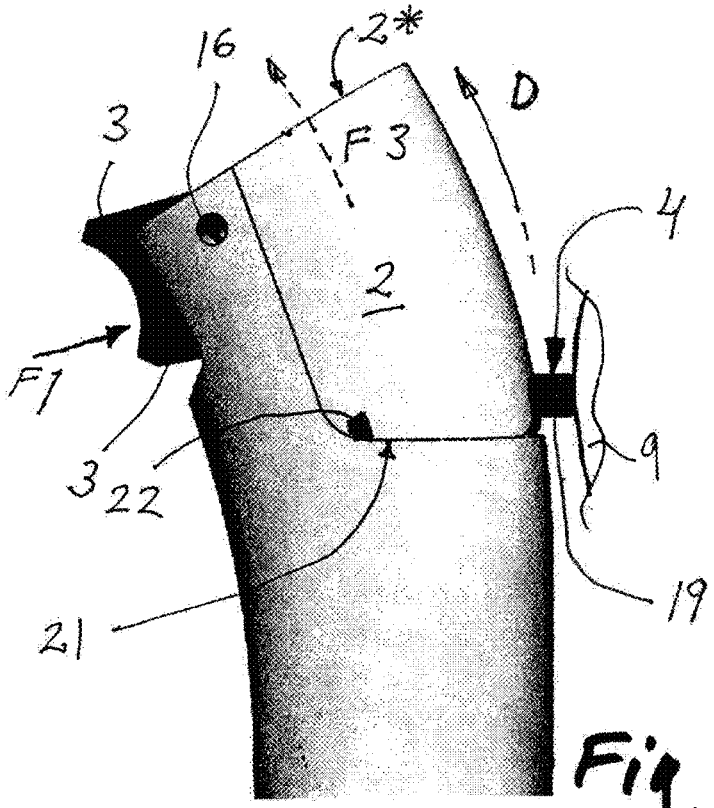
FIG. 2A shows the operation of the ski pole handle with the quick release strap of FIGS. 1A and 1B, and specifically in the position when the strap is completely coupled with the handle, in the same view as in FIG. 1B. In this state the ski pole can be used for skiing.
Figure 2B:
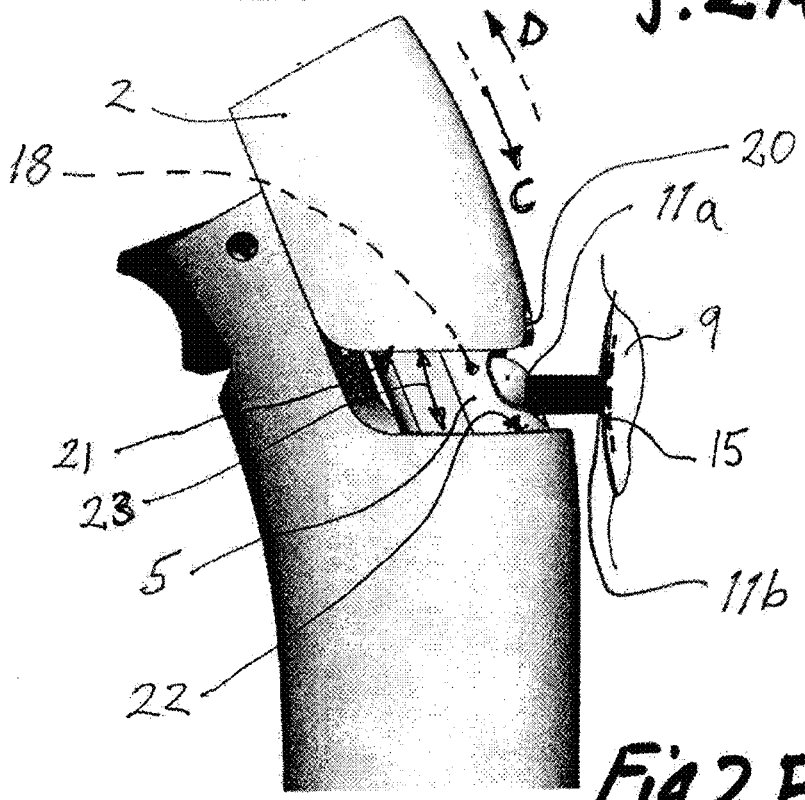
FIG. 2B shows the operation of the ski pole handle with the quick release strap of FIGS. 1A to 2A, and specifically in the position when the strap is beginning to uncouple from the handle or, respectively, when the strap is just re-coupling to the handle, in the same direction as in FIG. 2A. In this state the ski pole is ready to be laid away for e.g. rifle shooting or—vice versa—gripping anew by the skier.
Figure 2C:
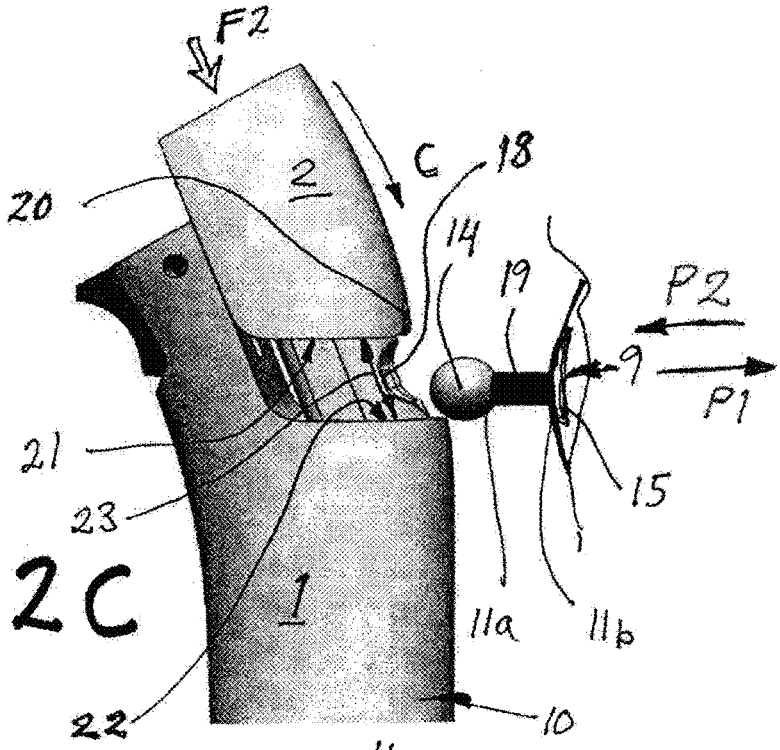
FIG. 2C shows the operation of the ski pole handle with the quick release strap of FIGS. 1A to 2B, and specifically in the position when the strap is just uncoupling from the handle or, respectively, when the strap is beginning to recouple to the handle, in the same view as in FIGS. 2A and 2B. In this state the ski pole is ready to be set aside for e.g. rifle shooting or—vice versa—gripping anew by the skier.

When the slide 2 is in its uppermost position, as visualized in FIG. 2C, the strap 9 is not locked to the handle 10,—the slide either moved or retained in its opening direction D, whereupon there is a gap 23 between the lower edge 21 of the slide and the intermediate edge 22 of the handle body, and then the strap with its pin 4 is separated from the handle. Further, the pin 4 can now be uncoupled from the handle, or re-coupled to the handle, or kept separate from the handle—like for shooting. When the slide 2 is in its lowermost position, as visualized in FIG. 2A, the strap 9 is locked to the handle 10,—the slide either moved or retained in its closing direction C, then the strap with its pin 4 is locked to the handle, and the intermediate edge 22 of the handle body are against each other, there being only the groove 20 open between these edges 21 and 22. And the beam goes through the groove. The lower edge 21 of the slide and the upper section 5*a* and a lower section 5*b* of the locking base 5 may be linear or have an obtuse angle there between, which angle opens towards the unlock lever 3. Both the uncoupling and the re-coupling is made single-handed.

A first pressing F1 of the unlock lever 3 releases the slide 2, so that the slide spring 7 moves the slide to its opening direction D, which opens a gap 23 between the lower edge 21 of the slide and an intermediate edge 22 of the handle body 1. Now the pin 4 with its widening 14 can be drawn outside the handle. While the slide 2 stays moved in its opening direction D by the slide spring 7 hence yielding a gap 23 between the lower edge 21 of the slide and an intermediate edge 22 of the handle body 1, the pin 4 with its widening can also—contrary to previous action—be inserted into the handle, until the widening is in the cavity 18. A second pressing F2 of the slide 2, against the top 2* of the slide 2, in its closing direction C against the slide spring 7 closes the gap 23 and locks the pin 4 in the handle.

The permanent magnets 8*a*, 8*b* in the lower section 5*b* of the locking base 5 coacts with the widening 14 of the soft magnetic material providing and ensuring a proper insertion of the pin 4. As a result the movement of the slide 2 in its closing direction C is possible.

It must be noted that above only some embodiments of the solution according to the invention have been described. The principle of the invention can naturally be modified within the scope of protection determined by the patent claims, e.g. in details of implementation.

The invention claimed is:

1. A combination of a handle (10) and a strap (9) of a ski pole (13), said strap adapted to be between a hand (12) of a person and said handle (10), and said combination allowing a quick uncoupling and re-coupling of said strap (9) with said hand (12) from and to said ski pole handle (10); said handle (10) comprising:

a handle body (1) securely fixed on said ski pole, a locking base (5) fixed in said body (1), a slide (2) movable in respect to said body (1) and said locking base (5), and an unlock lever (3) communicating with said slide (2) while shifted in respect to said body (1); and a pin (4) having a first end (11*a*) with a widening (14) and a second end (11*b*) fixing said pin to said strap (9) in a predetermined area (A) thereof, wherein, said strap (9) is shaped to enclose by contact and extend around a palm (12*a*) and a back of the hand (12) and between a thumb (12*c*) and forefinger (12*d*) of said hand (12) by tightening;

said predetermined area (A) of the strap is between a thumb (12*c*) and a forefinger (12*d*) of said hand;

said widening (14) of the pin (4) is of ferromagnetic material; and said handle further comprises:

a slide spring (7) between the slide (2) and the base (5); a lever spring (6) between the unlock lever (3) and the handle body (1); and at least one permanent magnet (8*a*, 8*b*) of ferromagnetic material for co-action with said widening (14), and a cavity (18) respective the size of said widening (14) in said locking base, and a transverse groove (20) opening outside at a lower edge (21) of the slide (2), so that a beam (19) between said first and second ends of the pin (4) extends out of the locking base to outside of the slide.

2. A combination of a handle and a strap of a ski pole according to claim 1, wherein said widening (14) in the first end of said pin (4) is spherical.

3. A combination of a handle and a strap of a ski pole according to claim 1, wherein said pin (4) has a flange (15) or a hole in the second end thereof enabling fixing of said pin to said strap (9).

4. A combination of a handle and a strap of a ski pole according to claim 1, wherein said locking base (5) has an upper section (5*a*) and a lower section (5*b*), whereupon said slide spring (7) is between said upper section (5*a*) and said slide (2), so as to force said slide in its opening direction (D); said slide (2) has configuration enabling a sliding of said slide (2) along said locking base (5) both in opening direction (D) and in opposite closing direction (C); and said unlock lever (3) has a revolve axis (16) transverse to the length (L) of said handle (10), and said lever spring (6) is pressing said unlock lever against the slide.

5. A combination of a handle and a strap of a ski pole according to claim 3, wherein a first pressing (F1) of the unlock lever (3) releases the slide (2) to move by said slide spring (7) in its opening direction (D), which opens a gap (23) between said lower edge (21) of the slide and an intermediate edge (22) of the handle body (1), whereupon the pin (4) with its widening can be drawn outside the handle.

6. A combination of a handle and a strap of a ski pole according to claim 3, wherein while said slide (2) stays moved in its opening direction (D) by said slide spring (7) hence yielding a gap (23) between said lower edge (21) of the slide and an intermediate edge (22) of the handle body (1), the pin (4) with its widening can be inserted into the handle, until the widening is in said cavity (18); and a second pressing (F2) of the slide (2) in its closing direction (C) against said slide spring (7) closes said gap and locks pin in the handle.

7. A combination of a handle and a strap of a ski pole according to claim 1, wherein said permanent magnet(s) (8*a*, 8*b*) co-acting with said widening (14) provides the proper insertion of the pin (4), whereupon the movement of the slide (2) in its closing direction (C) is ensured.

8. A method for quick uncoupling and re-coupling a strap (9) on a hand (12) from and to a handle (10) of a ski pole in a combination of said handle (10) and said strap (9) of a ski pole (13), said strap adapted to extend between the hand of a person and said handle (10); said handle (10) comprising:

a handle body (1) securely fixed on said ski pole, a locking base (5) fixed in said body (1), a slide (2) movable in respect to said body (1), and an unlock lever (3) communicating with said slide (2) while shifted in respect to said body (1); and a pin (4) having a first end (11*a*) with a ferromagnetic widening (14) and a second end (11*b*) fixing said pin to said strap (9) in a predetermined area (A) thereof, wherein, for quick uncoupling the strap with a hand from the handle:

said unlock lever (3) is forced by a first pressing (F1), whereupon said slide (2) is released and moves to an opening direction (D) by a third force (F3) of a slide spring (7), hence opening a gap (23) and allowing that said pin (4) with its widening (14) to be drawn out of the handle (10) by a first hand force (P1) of the skier; and for quick re-coupling the strap with a handle:

said pin (4) with its widening (14) is pushed into the handle (10) by a second hand force (P2) of the skier, until said widening is within a cavity (18) in said locking base (5) and ensured by at least one magnet (8*a*, 8*b*), whereafter said slide (2) is pressed down by a second pressing (F2) by the skier, thus securing the joining of the strap (9) and the hand (12) in said handle (10).

* * * * *